United States Patent [19]

Krowne et al.

[11] Patent Number: 4,862,119

[45] Date of Patent: Aug. 29, 1989

[54] NON-RECIPROCAL SEMICONDUCTOR DEVICE

[75] Inventors: Clifford M. Krowne; Gary A. Prinz; James J. Krebs, all of Alexandria, Va.

[73] Assignee: The United States of America as represented by the Secretary of the Navy, Washington, D.C.

[21] Appl. No.: 213,042

[22] Filed: Jun. 29, 1988

[51] Int. Cl.[4] ..... H01P 1/36

[52] U.S. Cl. ..... 333/24 R; 333/24.2

[58] Field of Search ..... 333/24 R, 24.1, 24.2, 333/247

[56] References Cited

U.S. PATENT DOCUMENTS

| | | | |
|---|---|---|---|
| 3,317,863 | 5/1967 | Ngo | 333/24.2 X |
| 3,534,276 | 10/1970 | Berteaud et al. | 333/24.2 X |
| 3,935,548 | 1/1976 | Rosenbaum et al. | 333/1.1 |
| 3,978,433 | 8/1976 | Naito et al. | 333/1.1 |
| 4,050,038 | 9/1977 | Noguchi et al. | 333/1.1 |
| 4,283,692 | 8/1981 | Adam | 333/171 |
| 4,614,923 | 9/1986 | Roveda et al. | 333/147 |
| 4,630,011 | 12/1986 | Neidert et al. | 333/164 |
| 4,689,585 | 8/1987 | Sequeria | 333/24.2 |
| 4,733,201 | 3/1988 | Helszajn et al. | 333/24.2 |

OTHER PUBLICATIONS

C. M. Krowne, "Fourier Transformed Matrix Method of Finding Propagation Characteristics of Complex Anisotropic Layered Media," IEEE Transactions on Microwave Theory and Techniques, vol. MTT-32, No. 12, p. 1617 (Dec. 1984).

E. M. Godshalk et al., "Non-Reciprocal Effects in Semiconductor Loaded Waveguide at Millimeter Wavelengths," 1984 IEEE Digest on Microwave Theory and Techniques-s, p. 455.

C. M. Krowne et al., "Solid State Monolithic Variable Phase Shifter with Operation into the Millimeter Wave Wavelength Regime," International Journal of Infrared and Millimeter Waves, vol. 7, No. 5, p. 715 (1986).

R. E. Neidert et al., "Voltage Variable Microwave Phase Shifter," Electronics Letters, vol. 21, No. 15, p. 636 (Jul. 18, 1985).

C. M. Krowne et al., "Slow Wave Monolithic Variable Phase Shifter," Digest, International Conference on Infrared Millimeter Waves, p. 275-76 (Dec., 1985).

G. A. Prinz et al., "Molecular Beam Epitaxial Growth of Single-Crystal Fe Films on GaAs," Applied Physics Letters, vol. 39, No. 5, p. 397 (Sep. 1, 1981).

G. A. Prinz et al., "Magnetic Properties of Single-Crystal [110] Iron Films Grown on GaAs by Molecular Beam Epitaxy," Journal of Applied Physics, vol. 53, No. 3, p. 2087 (Mar., 1982).

B. R. McCleod et al., "A 35-GHz Isolator Using a Coaxial Solid-State Plasma in a Longitudinal Magnetic Field," IEEE Transactions on Microwave Theory and Techniques, vol. MTT-19, No. 6, p. 510 (Jun. 1971).

D. M. Bolle et al., "Fundamental Considerations in Millimeter and Near-Millimeter Component Design Employing Magnetoplasmons," IEEE Transactions on Microwave Theory and Techniques, vol. MTT-29, No. 9, p. 916 (Sep. 1981).

G. A. Prinz, "Interface Effects on the Properties of Magnetic Metal Films Grown on GaAs by MBE," Characterization and Behavior of Materials with Submicron Dimensions, J. T. Walker, ed. (World Scientific Publishing Co. 1985).

C. M. Krowne et al., "Non-Reciprocal Millimeter Wave Propagation in Slot Guiding Structures using Magnetoplasmons," (unpublished manuscript).

*Primary Examiner*—Paul Gensler

*Attorney, Agent, or Firm*—Thomas E. McDonnell; A. David Spevack; Edward F. Miles

[57] ABSTRACT

A semiconductor device useable as an electromagnetic isolator. The device has a semiconductor substrate epitaxial with a layer of metal, the latter deposited so as to generate a residual magnetic flux. A waveguiding structure is disposed transverse to the flux effective to cause electromagnetic signals propagating in the waveguiding structure to be attenuated a different amount depending on the direction of propagation. The waveguiding structure is preferably a seminconductor layer deposited epitaxially with the substrate in a channel in the metal.

19 Claims, 2 Drawing Sheets

NON-RECIPROCAL SEMICONDUCTOR DEVICE

BACKGROUND OF THE INVENTION

The invention pertains most broadly to semiconductor devices, and more particularly to non-reciprocal semiconductor devices usable as isolators.

Non-reciprocal electromagnetic devices have long been important. A non-reciprocal device is one whose propagation constant $\gamma$ differs depending upon the direction of electromagnetic propagation, and such non-reciprocal devices commonly use ferrite and external magnets to generate the requisite magnetic fields. Unfortunately, ferrites are not useful above approximately 100 GHz. As higher frequency applications become more important, there is a greater need for non-reciprocal devices that not only operate well at these frequencies but are compatible with the semiconductor technology pertinent to such higher frequency applications, most especially monolithic devices based on compound semiconductor materials combining elements from columns III and V of the periodic table (III–V semiconductors) and columns II and VI of the periodic table (II–VI semiconductors). Additionally, to be most practical such devices should operate effectively at room temperature.

SUMMARY OF THE INVENTION

Accordingly, an object of the invention to enable the production of non-reciprocal devices using semiconductor technology.

Another object of the invention is to make such devices effective as isolators.

Another object of the invention is to make such devices effective for high frequency applications.

Another object of the invention is to make such devices compatible with standard semiconductor technology, most especially that of the III–V and II–VI semiconductors.

Another object of the invention is to make such devices integrable with other elements of monolithic integrated circuit technology.

Another object of the invention is to enable such devices to operate without external magnetic fields, nor attached separate magnets.

Another object of the invention is to enable such devices to operate effectively at room temperature.

In accordance with these and other objects made apparent hereinafter, the invention is predicated on an understanding of non-reciprocity.

In any material, the electromagnetic propagation constant $\gamma$ has a real part $\alpha$, associated with attenuation, and an imaginary part $\beta$ associated with phase, such that $\gamma=\alpha+\beta$. A semiconductor, or more broadly any material having a distribution of mobile carriers, has a permittivity tensor $\epsilon$ whose non-diagonal elements are zero in the absence of applied magnetic fields. Subjecting such a semiconductor to a magnetic field induces non-diagonal elements of $\epsilon$, the existence of which implies that the real portion $\alpha$ of the semiconductor's propagation constant $\gamma$ differs depending on the direction of signal propagation in the semiconductor, i.e. that the electromagnetic field traversing the material is displaced responsive to the applied magnetic field. Should such a material be the active portion of a waveguiding structure, and should the waveguiding structure be asymmetrically loaded transverse to both the flux of the applied magnetic field and the direction of signal propagation, the waveguiding structure acts as a nonreciprocal attenuator because the applied magnetic field displaces the signal within the waveguiding structure either towards or away from portions of the waveguiding structure that constitute greater or lesser loads. See, e.g., E. M. Godshalk et al., "Non-Reciprocal Effects in Semiconductor Loaded Waveguide at Millimeter Wavelengths," 1984 IEEE Digest of Microwave Theory and Techniques, p. 455. The magnetic field similarly affects $\beta$, additionally implying differential phase propagation in the semiconductor.

In its broadest form, the invention is a semiconductor device having a semiconductor substrate epitaxial with a layer of metal on the substrate. The metal is chosen and deposited epitaxially on the substrate in a manner to generate a residual and permanent magnetic field, in effect making the metallic layer a magnet. The semiconductor monolith has an integrally formed waveguiding structure, which is exposed to the flux of the magnetic field in a manner effective to cause the electromagnetic propagation constant $\gamma$ within the waveguiding structure to differ depending upon signal direction, i.e. to be non-reciprocal, as discussed above. In the preferred embodiment, the semiconductor is gallium arsenide, the metallic layer is an iron film epitaxial with the gallium arsenide substrate, the waveguiding structure is a channel through the iron film transverse to the magnetic field which is filled with a growth of gallium arsenide epitaxial with the substrate, and the asymmetric load is a microstrip line disposed along a portion of the gallium arsenide channel. The integral magnetic layer eliminates the need for external magnetic fields or attached magnets, and, each element being an epitaxial layer in a semiconductor monolith, is inherently compatible with semiconductor technology and achieves all the advantages of that technology. The rapid response time, and high carrier mobility at high temperatures, expected in III–V and II–VI semiconductors, and demonstrated in gallium arsenide, adapts the device to higher frequencies, and permits the device to operate effectively at room temperature, dispensing with the need for bulky and costly cryogenics.

The invention is more fully appreciated from the following detailed description of the preferred embodiment, it being understood, however, that the invention is capable of extended application beyond the precise details of the preferred embodiment. Changes and modifications can be made that do not affect the spirit of the invention, nor exceed its scope, as expressed in the appended claims. Accordingly, the invention is described with particular reference to the accompanying drawings, wherein:

DETAILED DESCRIPTION

Figure 1:
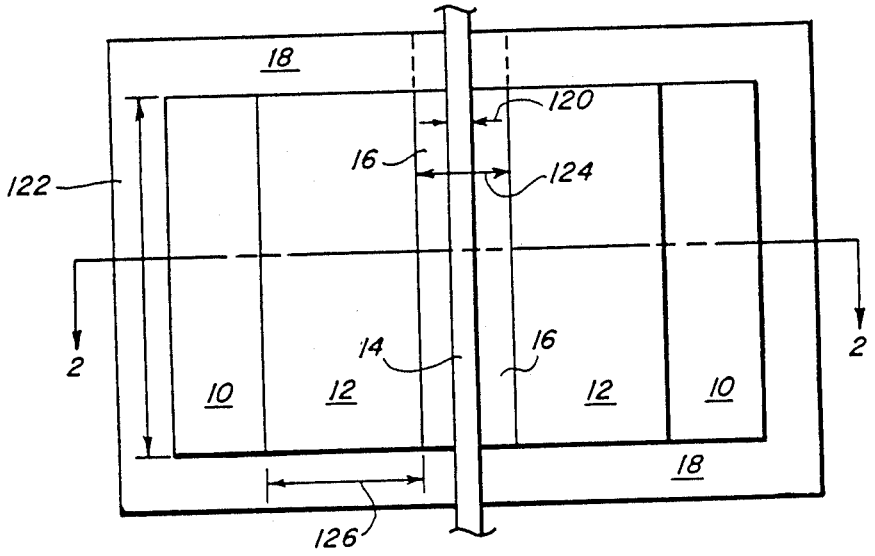
FIG. 1 is a top isometric view of the preferred embodiment.
Figure 2:
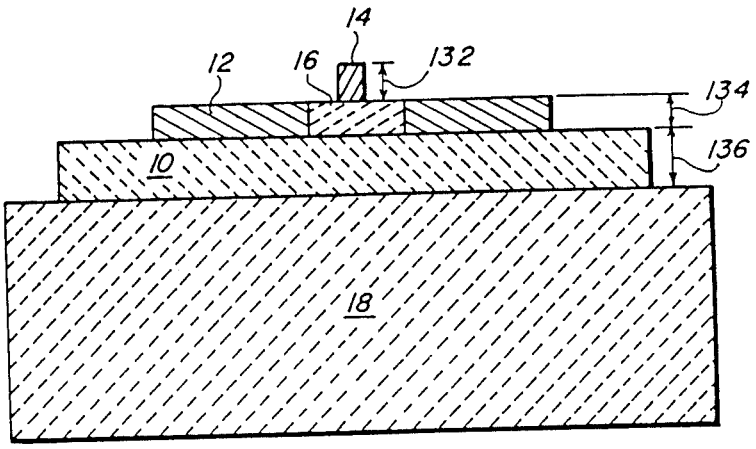
FIG. 2 is a sectional view in the direction of lines 2—2 of FIG. 1.
Figure 3:
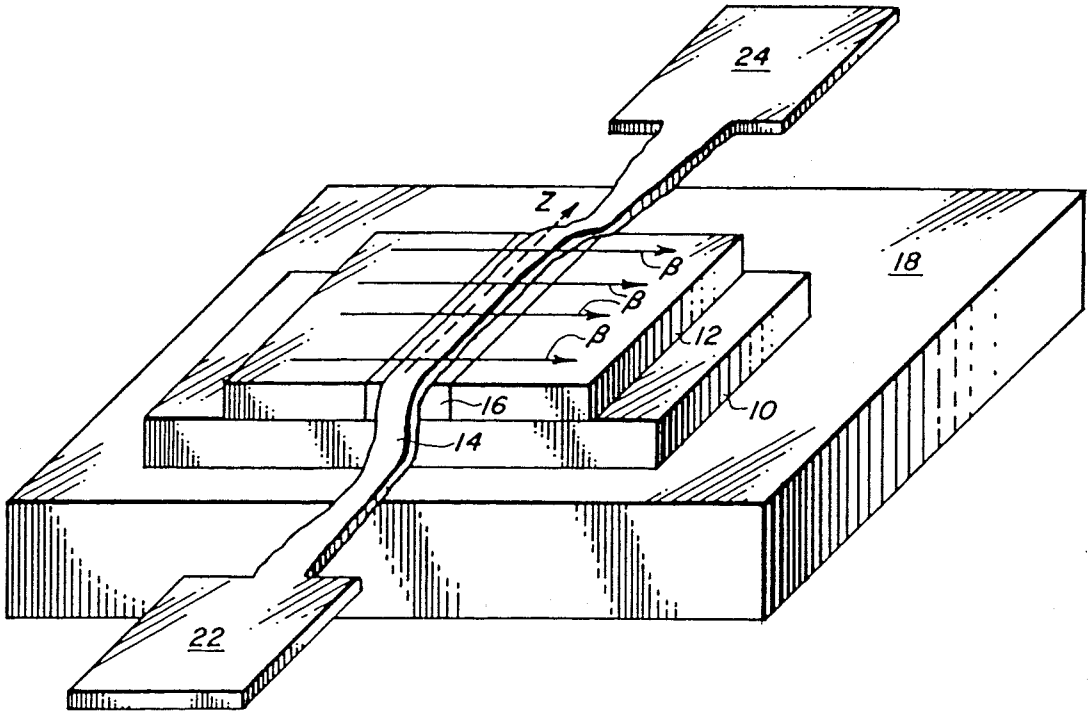
FIG. 3 is a top elevational view of the embodiment shown in FIGS. 1 and 2.

With reference to the drawing figures, a device is shown having most broadly three layers, 10, 12, 18. Layer 18 is a semi-insulating block of gallium arsenide which could, for example, be the ultimate substrate of a large integrated circuit in which the device shown in FIGS. 1–3 is one component. Epitaxial with layer 18 is another layer of gallium arsenide which itself acts as a substrate to metallic superlayer 12. Layer 10 is n+ doped to act as the device's ground plane. (If the device is one component of a large integrated circuit, layer 10 must, of course, be connected to the circuit's ultimate ground plane, which can be done in any conventional manner.) Iron film 12 of orientation (110) is grown epitaxially on the (110) surface of layer 10. The (110) face of iron contains magnetically hard [111], intermediate [110] and easy [001] axes. The specific magnetic anisotropy of iron is sufficient so that the iron atoms are deposited with their dipole moments aligned along the easy [001] direction, giving rise to a net residual magnetic field in layer 12. Both $\alpha$-iron and gallium arsenide are single crystal and, although gallium arsenide forms a face centered cubic crystal, and iron a body centered cubic crystal, the two are lattice matched to within 1.3% of one another. Moreover, the gallium arsenide face is relatively stable, which aids the uniform orientation of the iron dipoles. The direction of magnetic flux generated by this field is illustrated by the arrows in FIG. 3, labeled B. Channel 16 is cut through iron layer 12 perpendicular to flux B, and has disposed in it a further epitaxial growth of gallium arsenide. This further epitaxial growth is n doped to a carrier concentration several orders of magnitude less than that of layer 10. Atop the semiconductor in channel 16 is a microscope line metallization 14 having terminii, or pads, 22, 24, which are the input and output ports of the device. In addition to permitting layer 10 to act as a ground plane, the heavy doping in layer 10 constitutes a highly reflective boundary to electromagnetic propagation traversing channel 16, and, in conjunction with iron layer 12 and micro-stripline 14, form roughly the boundaries of an open rectangular waveguiding structure, the operating parameters of which are well understood. (Of course, the geometry of the waveguiding structure formed in channel 16 need not be rectangular, but can be of any kind demanded by any application of the teachings of the invention.) Microstrip line 14 covers only a portion of the surface of channel 16, and consequently provides leakage for the fields within channel 16. This leakage constitutes the asymmetric loading of this embodiment. Another advantageous way to provide the requisite asymmetric loading is to dope the semiconductor of channel 16 to have a preselected profile transverse to the flux B, and to the direction of signal propagation, so as to place more of less carriers at points of expected high signal strength. The calculation of such high (or low) field points is understood by those skilled in this art, or otherwise knowledgable of the design of conventional waveguiding structures. Microstrip line 14 can be unbiased, or biased with a setpoint potential to further displace the electric field within channel 16 to points of high and low carrier concentration, as desired. An insulating layer (not shown) between microstripline 14 and the semiconductor in channel 16 may be used to prevent current flow between micro-stripline 14 and channel 16, and can advantageously be in the form of a metal-oxide Shottky barrier. The forming of epitaxial layers 10, 12, 18 can be done by any conventional technique for growing multilayered semiconductors and metal films, such techniques being well understood by those skilled in the art, for example molecular beam epitaxy, or even sputtering. The formation of the device's particular mesas, and the forming of the gap in metallic layer 12 in which channel 16 is formed, can similarly be done by well understood and conventional techniques of semiconductor fabrication, for example, photolithography.

The preferred embodiment employs gallium arsenide as its semiconductor and iron as its magnetic material because of gallium arsenide's exceptional response time, and iron's exceptional ferromagnetic properties. (Such iron films can generate magnetic flux densities of at least $2(10)^3$ Gauss over a one micrometer gap.) More broadly, however, the invention can be practiced using a film of any ferromagnetic material that has a sufficiently high specific magnetic moment to ensure a strong residual magnetic field, a sufficiently high magnetic anisotropy to ensure that the moments of the atoms of the epitaxial magnetic film align in the same (i.e. "easy") direction, and a semiconductor on which the film can be stably grown. Magnetic moment and anisotropy are both material parameters, and one skilled in the art can determine which magnetic materials are appropriate once having been instructed by the teachings of this disclosure. By way of example, a typical value of appropriate specific magnetic moment is about 0.5 Bohr magnetons per atom, or greater; and a typical value of appropriate magnetic anisotropy is about $10^5$ ergs $cm^{-3}$, or greater. Any 3p transition metal such as nickel and cobalt (in addition to iron), or alloys of iron, nickel, and cobalt can be used advantageously to form the magnetic film. Additionally, the known properties of 4f transition elements (i.e. lanthanides) suggest that they and their alloys could be used also once their crystallographic behaviors are well enough tested to ensure that they can be grown reliably as epitaxial films. Similarly, once ferrite films can be grown reliably, such films can be used for lower frequency applications. Besides gallium arsenide, any III–V (n.b. indium phosphide) or II–VI (n.b. zinc selenide) semiconductor or germanium can be used as the substrate for the magnetic film.

As with any semiconductor, the finished device can advantageously have deposited about its surface a protective insulating layer of any appropriate and well known oxide of silicon, or like material (not shown). Exemplary dimensions for the device are:

| Drawing Reference | Dimension | Magnitude |
|---|---|---|
| 120 | width of micro-stripline 14 | 1–2 micrometers |
| 122 | length of film 12 | 1–2 millimeters |
| 124 | width of channel 16 | 3 micrometers |
| 126 | width of film 12 | 5–10 micrometers |
| 132 | height of microstripline 14 | at least 0.5 micrometers |
| 134 | height of film 12 | 1 micrometer |
| 136 | height of substrate 10 | at least 2 micrometers |
| (none) | doping of n+ substrate 10 | at least $2(10)^{18}cm^{-3}$ |
| (none) | doping of channel 16 | about $10^{16}cm^{-3}$ |

In operation, the device forms a waveguiding structure with pads 22, 24 constituting the input and output, and gallium arsenide n+substrate 10 operating as the device's ground plane. Electromagnetic radiation propagates along stripline 14 in the direction indicated in FIG. 3 as z, and the magnetic flux B across channel 16 induces non-reciprocity in the gallium arsenide in channel 16, as discussed above, so that signals propagating along the z direction are attenuated preferentially depending upon whether propagation is from 22 to 24, or vice-versa. As with any semiconductor, cooling the device increases carrier mobility and hence device performance; but a proper selection of the materials used, as discussed above, will enable the device to work well at room temperature.

The invention is shown in what is considered to be the most practical and preferred embodiment, and is done so for purposes of illustration rather than limitation. Plainly, obvious modifications within the scope of the invention may occur to those skilled in this art. For example, although the invention is presently of interest as an isolator, it can also be used as a differential phase shifter, in accordance with the teachings above. Accordingly, the scope of the invention is to be discerned solely by reference to the appended claims, wherein:

What is claimed and desired to be secured by Letters Patent of the United States is:

1. A semiconductor device comprising:
a semiconductor substrate;
a layer of metal epitaxial with said substrate, the moments of the atoms of said layer of metal being oriented effective to create a net magnetic field across said layer of metal;
a waveguiding means for transmitting electromagnetic radiation, said waveguiding means being located so as to be exposed to said magnetic field effective to permit said magnetic field to cause the electromagnetic propagation constant of said waveguiding means to differ depending on the direction that said electromagnetic radiation traverses said waveguide.

2. The device of claim 1, wherein said semiconductor substrate is of gallium arsenide, and said layer of metal is of iron.

3. The device of claim 1 wherein said waveguiding means comprises a channel extending through said layer of metal.

4. The device of claim 3 wherein said channel has an additional layer of semiconductor epitaxial with said substrate.

5. The device of claim 4 wherein said substrate is more heavily doped than said additional layer in an amount effective to cause said substrate to act as at least a portion of the boundary of said waveguiding means.

6. The device of claim 5 wherein said device comprises a strip line, said strip line being disposed effective to act as at least a second portion of said boundary of said waveguiding means, said strip line further comprising two terminii portions, one each of said terminii being adapted to constitute the input and output of said device.

7. The device of claim 6 wherein said channel is disposed perpendicularly to the direction of flux of said magnetic field.

8. The device of claim 7 wherein said moments of said atoms of said layer of metal are oriented along the magnetically easy direction.

9. The device of claim 8 wherein:
said semiconductor substrate and said additional layer of semiconductor are each selected from the group consisting of: III–V semiconductor compounds; and II–VI semiconductor compounds;
and wherein said layer of metal comprises metals selected from the group consisting of: cobalt; nickel; iron; and alloys of at least two of cobalt, nickel or iron.

10. The device of claim 9, wherein said semiconductor substrate and said additional layer are of gallium arsenide, and said layer of metal is of iron.

11. The device of claim 1 wherein said moments of said atoms of said layer of metal are oriented along the magnetically easy direction.

12. The device of claim 11, wherein:
said semiconductor substrate is selected from the group consisting of:
III–V semiconductor compounds; and II–VI semiconductor compounds;
and wherein said layer of metal comprises metals selected from the group consisting of: cobalt; nickel; iron; and alloys of at least two of cobalt, nickel or iron.

13. The device of claim 12, wherein said semiconductor substrate is of gallium arsenide, and said layer of metal is of iron.

14. The device of claim 1 wherein:
said semiconductor substrate is selected from the group consisting of III–V semiconductor compounds; and II–VI semiconductor compounds;
and wherein said layer of metal comprises metals selected from the group consisting of: cobalt; nickel; iron; and alloys of at least two of cobalt, nickel or iron.

15. The device of claim 14, wherein said semiconductor substrate and said additional layer are of gallium arsenide, and said layer of metal is of iron.

16. A method for using a semiconductor device, said semiconductor device comprising:
a semiconductor substrate;
a layer of metal epitaxial with said substrate, the moments of the atoms of said layer of metal being oriented effective to create a net magnetic field across said layer of metal;
a waveguiding means for transmitting electromagnetic radiation, said waveguiding means being located so as to be exposed to said magnetic field effective to permit said magnetic field to cause the real portion of the electromagnetic propagation constant of said waveguiding means to be different depending on the direction said electromagnetic radiation traverses said waveguide;
said method comprising steps for:
exposing said waveguiding means to said radiation effective to permit said radiation to traverse said waveguide;
permitting said different real portion of said propagation constant to cause said device to be effective as an isolator.

17. A signal isolator, said isolator comprising:
a semiconductor substrate;
waveguiding means epitaxial with said substrate for transmitting an electromagnetic signal;
magnetic means for establishing a magnetic flux transverse to propagation of said signal in said waveguiding means;
said waveguiding means comprising means for cooperating with said magnetic means to produce nonreciprocal attenuation of said signal; wherein
said magnetic means is a magnetic film epitaxial with said substrate.

18. The isolator of claim 17, wherein said waveguiding means comprises an active portion, and wherein:
said magnetic film has a channel; and
said active portion comprises a layer of semiconductor disposed in said channel.

19. The isolator of claim 18, wherein said magnetic film is a member of the group consisting of: 3p transition metals; and alloys of 3p transition metals with one another.

* * * * *